United States Patent [19]

Tabet

[11] 4,182,073

[45] Jan. 8, 1980

[54] TWIN FLYING SAUCER TOY

[76] Inventor: Michael A. Tabet, 1302 Pamela Pl., Norfolk, Va. 23518

[21] Appl. No.: 905,941

[22] Filed: May 15, 1978

[51] Int. Cl.[2] ..... A63H 27/00

[52] U.S. Cl. ..... 46/74 D; 273/106 B

[58] Field of Search ..... 46/74 D, 75, 74 R; 273/106 B, 106 R; 244/12.2

[56] References Cited

U.S. PATENT DOCUMENTS

| | | | |
|---|---|---|---|
| 3,545,760 | 12/1970 | Wilson | 46/74 D |
| 3,855,728 | 12/1974 | Hynds | 46/74 D |

*Primary Examiner*—Louis G. Mancene
*Assistant Examiner*—Mickey Yu
*Attorney, Agent, or Firm*—Stevens, Davis, Miller & Mosher

[57] ABSTRACT

A toy rotary aircraft of the "Frisbee" type which is adapted to be manually thrown through the air while spinning about its vertical axis has two disc-shaped members secured together one above the other. The toy has improved stability at slower speeds which adapts it for catching with greater safety and less chance of it being dropped.

3 Claims, 4 Drawing Figures

TWIN FLYING SAUCER TOY

This invention relates generally to toys and, more particularly, to a toy aircraft of the concave-convex disc or air foil type.

Concave-convex discs have become popular as a toy not only for children but for adults as well. Such toys have become known as "Frisbees" and are usually manually cast into the air with a spinning motion by one person in the general direction of a second person who catches it and embarks it with a spinning motion on a return flight or towards a third person. The disc is caught while in flight by grasping it by hand to stop its rotation and forward progress.

Most adult men can repeatedly catch the toy without injury and often without dropping it before it is again placed in flight. However, some of the frailer adults and small children experience difficulty in stopping the flight of the spinning disc particularly if it has been cast into flight at a high speed.

It is therefore an object of this invention to improve a flying disc toy aircraft of the type described to adapt it for small children and frail adults as well as for male athletes and other physically strong adults.

Other objects will become apparent from the following description with reference to the accompanying drawing wherein FIG. 1 is a perspective view of one embodiment of the invention;

The foregoing objects and others are accomplished in accordance with this invention, generally speaking, by providing a toy aircraft having two concave-convex discs fastened together one above the other in spaced relationship and adapted to be manually thrown outwardly and upwardly with a rotary motion applied thereto at a speed in flight whereby its flight can be arrested by grasping it at its peripheral edge with reduced danger of injury and with reduced physical effort. It has been found that a toy having two concave-convex discs of the Frisbee type mounted one above the other has improved stability in flight at slower speeds than the single disc toy and thus can be thrown at speeds at which it can be caught even by small children.

Figure 1:
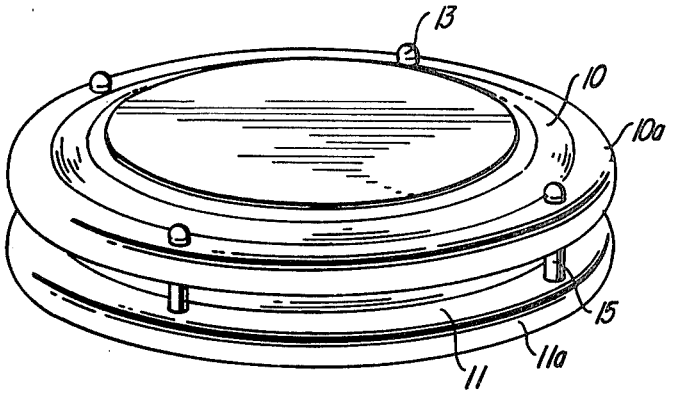

Referring now to the drawing, one embodiment of the invention is illustrated in FIG. 1 having two substantially concaveconvex plastic discs 10 and 11 fastened together by threaded pins 12 and nuts 13 and 14. Illustrated pins 12 and nuts 13 and 14 are metal but may be plastic such as nylon 6 or nylon 66. Sleeves 15 are disposed about pins 12 and are of a length to provide the desired spacing between discs 10 and 11. The pins 12 extend through holes in discs 10 and 11. The holes all have diameters which permit the pins to extend therethrough but are too small for the sleeves 15 to enter. Hence, discs 10 and 11 rest on the ends of sleeves 15. Alternately, a plastic or metal pin having a diameter larger than the diameter of the holes in the discs and threaded ends of a diameter which will enter the holes may be used with the discs being disposed on the shoulders formed at the juncture of the pin body with the threaded end portion of smaller diameter.

It will be noted that discs 10 and 11 are of substantially equal diameter and are of similar configuration. Disc 10 is disposed with its concave surface facing the convex surface of disc 11. Each disc has a depending flange 10*a* and 11*a* around its periphery to avoid sharp edges. The flanges 10*a* and 11*a* are integral with the disc body. Those portions of the discs 10 and 11 immediately surrounding the vertical axes are substantially flat raised portions 16. The peripheral edge of the raised portion 16 is connected through a sloping band portion 17 to peripheral flange 10*a* or 11*a*. This band 17 has a plurality of step-wise ridges formed by concentric radially spaced rings which assist in grasping the toy when it is caught.

Pins 12 and sleeves 15 may be made of a relatively soft flexible plastic to minimize the chance of injury to a finger or hand when the toy is caught provided the assembly of pin and sleeve is sufficiently rigid to maintain the spacing between discs 10 and 11.

Figure 2:
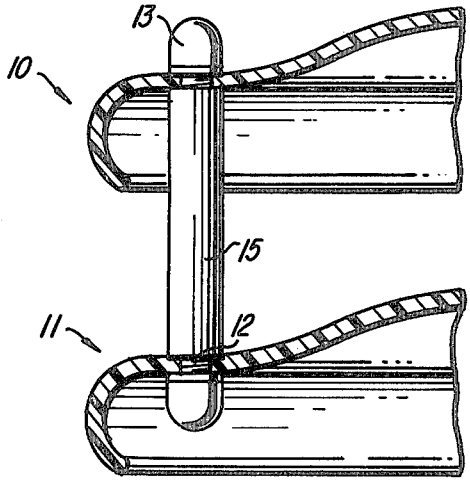
FIG. 2 is a fragmentary section of the embodiment of FIG. 1 illustrating the peripheral edge.
Figure 3:
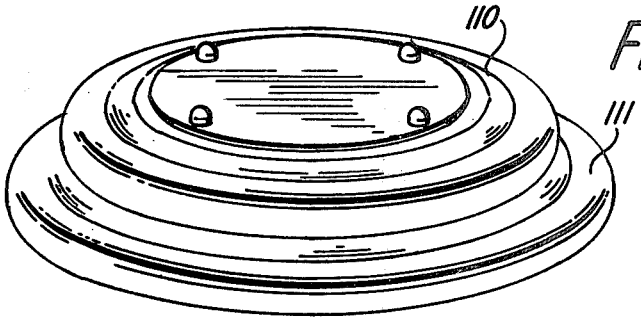
FIG. 3 is a perspective view of a second embodiment of the invention.
Figure 4:
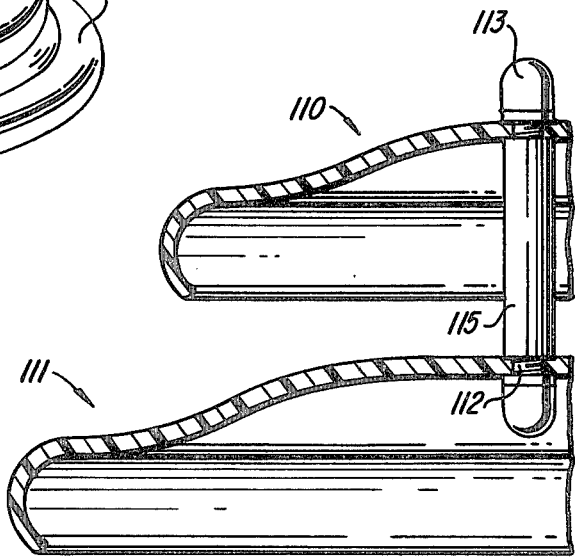
FIG. 4 is a fragmentary section of the embodiment of FIG. 3 illustrating a peripheral edge thereof.

The embodiment illustrated in FIGS. 3 and 4 is similar to that of FIGS. 1 and 2 except that discs 110 and 111 are of unequal diameters with disc 111 being larger than disc 110. Bolts or threaded pins 112 and nuts 113 secure the discs together on the ends of sleeves 115. This facilitates the throwing and catching of the spinning toy particularly by small hands. The disc of larger diameter may be the top disc instead of the bottom one.

The disc shaped members may be molded from any substantially rigid plastic such as acrylonitrile-butadiene-styrene (ABS), polyvinyl chloride, polyethylene or the like.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A toy adapted to be manually thrown upwardly and outwardly into the air with rotation about its vertical axis and to be caught by grasping its rotating peripheral edge while in flight comprising a pair of vertically spaced concave-convex shaped disc members secured together at circumferentially spaced points near their peripheral edges.

2. The toy of claim 1 wherein each disc shaped member has a depending flange integral with its peripheral edge and said peripheral edge is curved in cross-section.

3. The toy of claim 1 wherein the said disc shaped members are connected together by means of circumferentially spaced pins threaded at each end which extend through holes in the discs and nuts threadably mounted on the pins, and a sleeve on each pin between the discs having a cross-section larger than the cross-section of the holes whereby the discs are disposed on the ends of the sleeves.

* * * * *